US005649745A

United States Patent [19]

Anderson

[11] Patent Number: 5,649,745

[45] Date of Patent: Jul. 22, 1997

[54] INFLATABLE GRIPPER ASSEMBLY FOR ROCK BORING MACHINE

[75] Inventor: Llewellan Anderson, Renton, Wash.

[73] Assignee: Atlas Copco Robbins Inc., Kent, Wash.

[21] Appl. No.: 537,631

[22] Filed: Oct. 2, 1995

[51] Int. Cl.[6] ..... E21C 29/00

[52] U.S. Cl. ..... 299/31

[58] Field of Search ..... 299/31, 32, 33; 405/199; 175/98, 99

[56] References Cited

U.S. PATENT DOCUMENTS

| | | | |
|---|---|---|---|
| 2,946,578 | 7/1960 | De Smaele . | |
| 3,088,532 | 5/1963 | Kellner . | |
| 3,105,561 | 10/1963 | Kellner . | |
| 3,126,971 | 3/1964 | Kellner et al. . | |
| 3,180,436 | 4/1965 | Kellner et al. . | |
| 3,298,449 | 1/1967 | Bachman et al. . | |
| 3,376,942 | 4/1968 | Van Winkle . | |
| 3,844,002 | 10/1974 | Slemmons | 405/199 |
| 3,881,776 | 5/1975 | Fashbaugh et al. | 299/31 |
| 4,030,698 | 6/1977 | Hansen | 254/106 |
| 4,463,814 | 8/1984 | Horstmeyer et al. . | |
| 5,186,264 | 2/1993 | du Chaffaut . | |

*Primary Examiner*—William P. Neuder
*Attorney, Agent, or Firm*—Graybeal Jackson Haley LLP

[57] ABSTRACT

An inflatable gripper assembly for a rock boring or cutting machine is disclosed. The inflatable gripper assembly comprises a base member and an elastomeric sheet secured in a fluid-tight and reaction force secure manner to the base member. The elastomeric sheet expands when fluid is supplied between the base member and the elastomeric sheet to brace a rock boring or cutting machine in a tunnel. The elastomeric sheet contracts when fluid is removed from between the base member and the elastomeric sheet to allow the rock boring or cutting machine to move within the tunnel.

28 Claims, 8 Drawing Sheets

INFLATABLE GRIPPER ASSEMBLY FOR ROCK BORING MACHINE

BACKGROUND OF THE INVENTION

The invention generally pertains to gripping mechanisms for rock or earth boring or cutting machines, and more specifically relates to inflatable gripping devices for rock or earth boring or cutting machines.

U.S. Pat. No. 2,946,578 issued to DeSmaele disclosed an excavator apparatus having a fitting circumferentially disposed therearound wherein the fitting comprises a deformable peripheral casing. The casing can be deformed by injection of an appropriate fluid under pressure. The deformed casing comes into tight engagement with the walls of the bore hole to allow a second portion of the machine to move with respect to the first portion of the machine that is gripped within the bore hole by the deformable peripheral casing. As best shown in FIG. 4 of DeSmaele, the deformable peripheral casing is comprised of rim 26, whose diameter exceeds slightly the diameter of body 2 of the excavating machine. The rim 26 covers at its front end a sleeve 138 fastened to the head plate 10. The ceiling between a collar 214 fastened to the rim 26 on the sleeve 138 is effected by a rubber seal 211, clamped to the flange 214 of the rim 26 by reinforced collar 215 bolted to the flange 214. The rim 26 is provided at its middle part with a peripheral reinforced rubber fitting 28 which is applied and held on the rim 26 by a ring 216 comprised of three arcuated parts, assembled by two rings 216*a* and 216*b*. The fitting contains three chambers or cushions 200, 201 and 202 arranged circumferentially. These cushions are connected by nipples 217, 218 and 219 to air tubes 203, 204 and 205. It is important to note, as stated above, that ring 216, to which cushion 201 is attached, is comprised of arcuate members that contour the external surface of the excavating machine. Thus, the arcuate segments of ring 216 are specifically designed for an excavating machine having a very precise diameter, and the arcuate members of ring 216 cannot be employed on an excavating machine having a different diameter.

Referring to FIG. 9A of DeSmaele, it is important to note that the length of elastomeric tail fitting 28 and of cushion 201 is substantially greater than the length of ring 216, which forms the base onto which elastomeric tail fitting 28 and cushion 201 are attached. Thus, as cushion 201 is inflated to extend elastomeric tail fitting 28 to brace the excavating machine in the bore hole, elastomeric tail fitting 28 and cushion 201 are subject to extreme movement relative to the tunnel and the excavating machine in a direction parallel with the longitudinal axis of the excavating machine. This relative movement of elastomeric tail fitting 28 and of cushion 201 causes extensive wear at the point of contact between both cushion 201 and elastomeric tail fitting 28 with ring 216, such that cushion 201 and elastomeric tail fitting 28 are prone to tear or separate from ring 216.

In addition to the above patent, which pertains to stabilizing an excavating machine for drilling substantially horizontal bore holes, prior art patents exist for stabilizing a drill string or the like in a substantially vertical bore hole. Exemplary patents include U.S. Pat No. 3,088,532 issued to Kellner; U.S. Pat No. 3,105,561 issued to Kellner; U.S. Pat No. 3,126,971 issued to Kellner; U.S. Pat No. 3,180,436 issued to Kellner et al.; U.S. Pat. No. 3,298,449 issued to Bachman et al.; U.S. Pat. No. 3,376,942 issued to Van Winkle; U.S. Pat No. 4,463,814 issued to Horstmeyer et al.; and U.S. Pat No. 5,186,264 issued to du Chaffaut. As in DeSmaele, all of the above patents disclose elastomeric inflatable portions and substantially arcuate base segments such that the arcuate base segments cannot be applied to a machine having a different diameter. Furthermore, the devices of all of the above patents disclose stabilizing, guiding or bracing members that do not completely circumferentially encase a portion of the exterior surface of the boring or cutting apparatus.

A need thus exists for an inflatable gripper assembly for a rock boring or cutting machine having a base member and elastomeric sheet secured in a fluid-tight manner to the base member that is configurable in a first deflated configuration and a second inflated configuration.

A need thus exists for the above type of inflatable gripper assembly in which the base member is planar, such that the inflatable gripper assembly can be installed on a plurality of rock boring or cutting machines, each having a different diameter.

A need further exists for the above type of inflatable gripper assembly wherein the length of the elastomeric sheet, when inflated, is no greater than the length of the base member, and the width of the elastomeric sheet, when inflated, is no greater than the width of the base member, such that movement of the elastomeric sheet relative to the tunnel and parallel with the longitudinal axis of the rock boring or cutting machine is minimized.

A need additionally exists for the above inflatable gripper assembly wherein when the cutting diameter of a rock boring or cutting machine is increased by increasing the diameter of the cutter head of the rock boring or cutting machine, the number of inflatable gripper assemblies attached to the outer surface of the rock boring or cutting machine can be increased, and a lengthening shim having a predetermined depth can be located between each inflatable gripper assembly on the exterior surface of the rock boring or cutting machine.

SUMMARY OF THE INVENTION

An inflatable gripper assembly for a rock boring or cutting machine is disclosed. The inflatable gripper assembly comprises a base member and an elastomeric sheet secured in a fluid-tight and reaction force secure manner to the base member. The elastomeric sheet expands when fluid is supplied between the base member and the elastomeric sheet to brace a rock boring or cutting machine in a shaft or tunnel. The elastomeric sheet contracts when fluid is removed from between the base member and the elastomeric sheet to allow the rock boring or cutting machine to move within the shaft or tunnel.

Most preferably, the base member is planar such that the inflatable gripper assembly can be installed on a plurality of rock boring or cutting machines, each having a different diameter or cutting size.

Preferably, the length of the elastomeric sheet when inflated is no greater than the length of the base member, and the width of the elastomeric sheet when inflated is no greater than the width of the base member, such that movement of the inflatable gripper assembly relative to the excavation and parallel with the longitudinal axis of the rock boring or cutting machine is minimized.

The base member preferably has a circumferential ridge located thereon and the elastomeric sheet has an outer edge that is secured over the ridge of the base member in a fluid-tight manner. This configuration further minimizes movement of the inflatable gripper assembly with respect to the excavation in a direction parallel with the longitudinal axis of the rock boring or cutting machine.

When the cutting diameter of a rock boring or cutting machine is to be increased by, for example, increasing the diameter of the cutter head of the rock boring or cutting machine, the number of gripper assemblies attached to the outer surface of the rock boring or cutting machine is increased and a shim having a predetermined depth is located between each gripper assembly and the exterior surface of the rock boring or cutting machine in order to increase the effective diameter of the rock boring or cutting machine such that gripping can occur by the gripper assemblies in the shaft or tunnel, which will have a larger diameter due to the increased diameter of the cutter head.

BRIEF DESCRIPTION OF THE DRAWINGS

These and other features of the present invention will be more fully appreciated when considered in light of the following specification and drawings in which.

DETAILED DESCRIPTION OF THE PREFERRED EMBODIMENT

Figure 1:
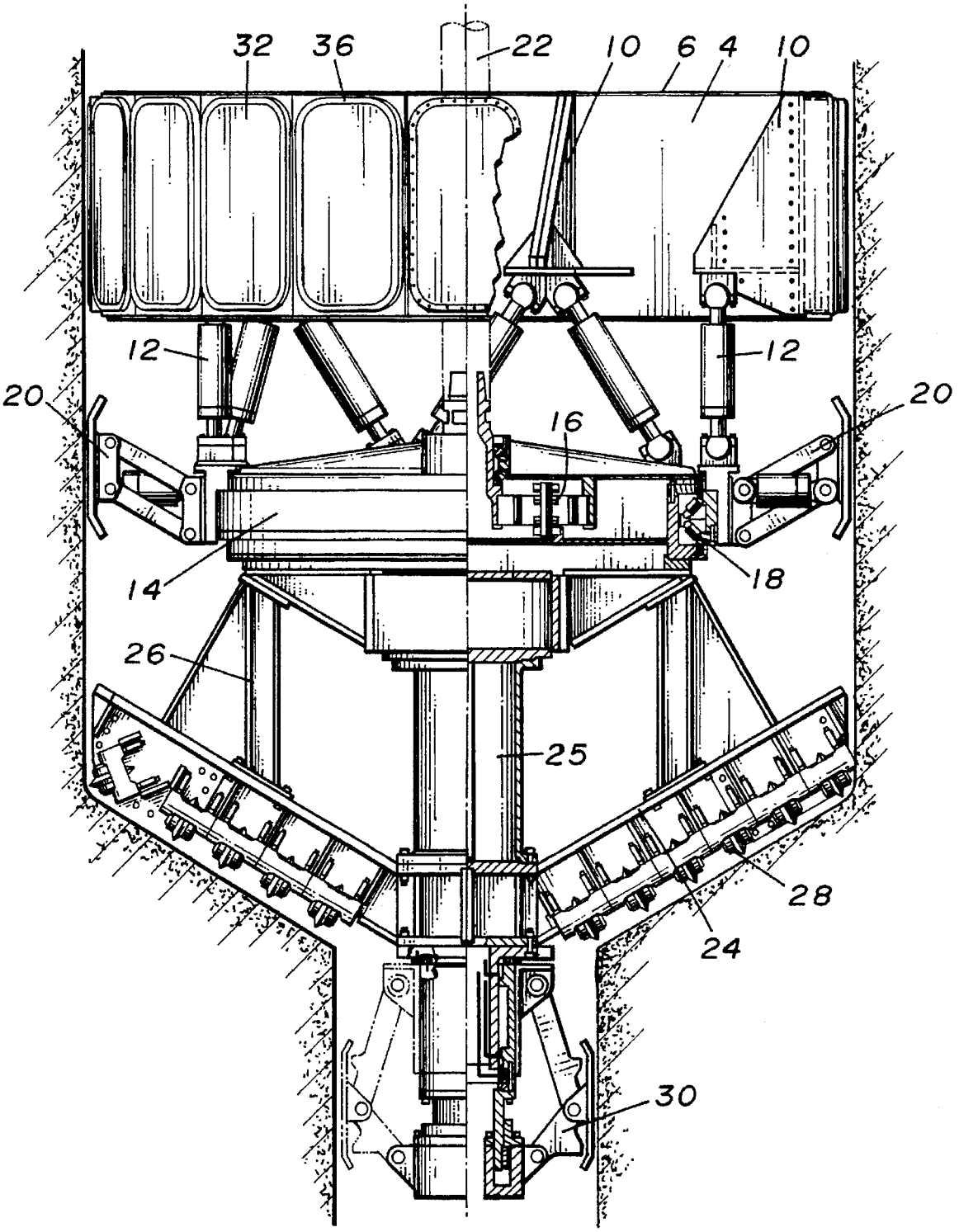
FIG. 1 is a side elevational view, partially exposed, of the inflatable gripper assembly of the present invention attached to a first exemplary rock boring machine.
Figure 2:
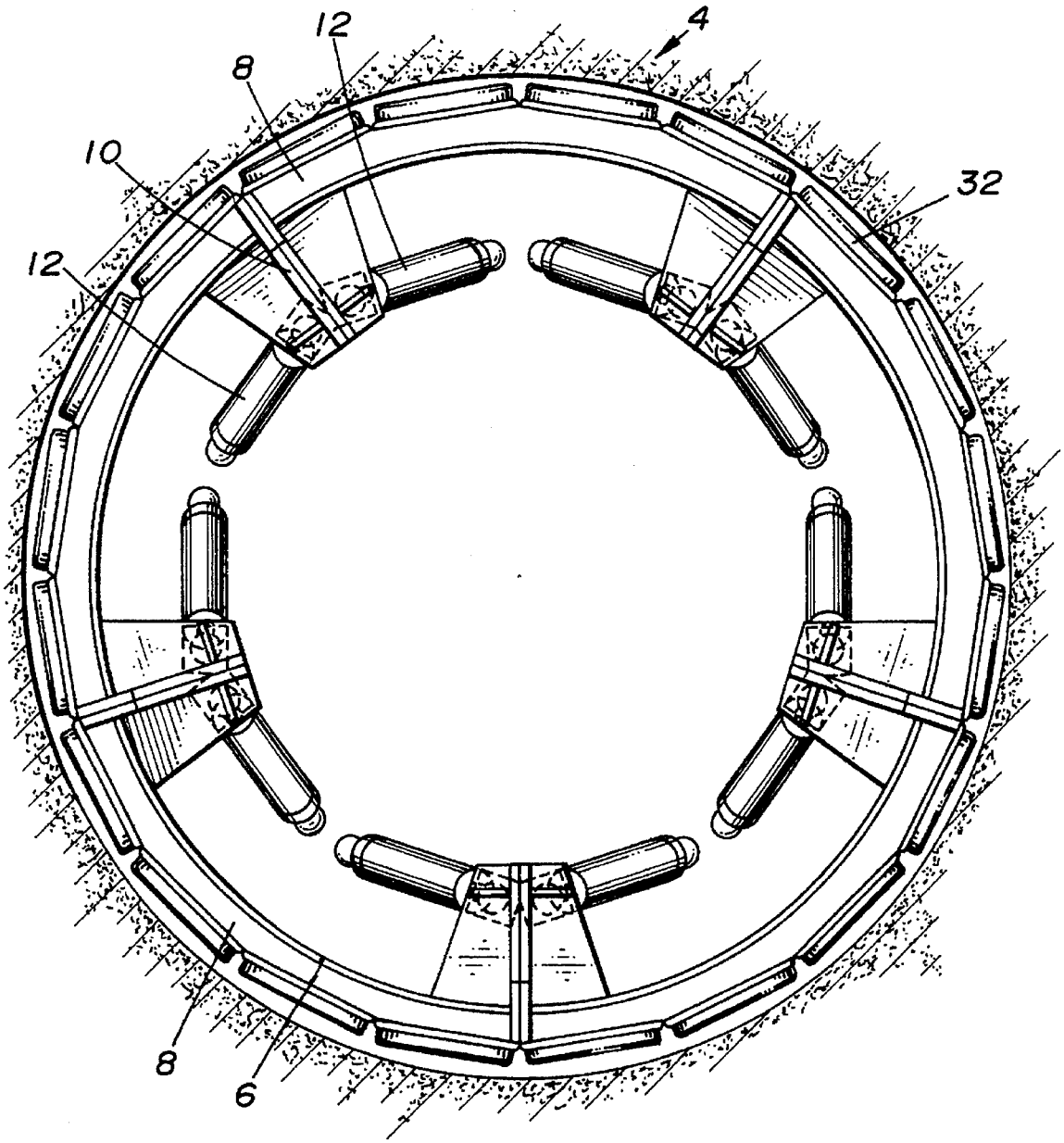
FIG. 2 is a partially exposed top view of the inflatable gripper assembly of the present invention attached to the first exemplary rock boring machine.

Referring to FIGS. 1 and 2, down reamer 2 is shown as an exemplary rock or earth boring or cutting machine for use with inflatable gripper assembly 4 of the present invention. It is to be understood that down reamer 2 is merely exemplary and is not intended to limit the scope of the subject invention, as inflatable gripper assembly 4 can be employed to intermittently grip almost any configuration of rock or earth boring or cutting machine in a bored hole or cut excavation. For example, inflatable gripper assembly 4 can also be employed on tunnel boring machines which bore a substantially horizontal tunnel through the earth or rock, as disclosed in U.S. Pat No. 2,946,578 issued to DeSmaele. Inflatable gripper assembly 4 is comprised of mounting frame 6 which, as shown best in FIG. 2, is comprised of a plurality of arcuate segments 8 that are interconnected such that mounting frame 6 is substantially circular. A plurality of flanges 10 disposed along the interior of arcuate segments 8 of mounting frame 6 connect a plurality of thrust cylinders 12 to mounting frame 6. Thrust cylinders 12 also connect mounting frame 6 to planetary gear box 14 having planetary gears 16 therein. Main bearing 18 is circumferentially disposed around the periphery of planetary gearbox 14. Stabilizing feet 20 are attached to the periphery of planetary gearbox 14 and provide stabilization of planetary gearbox 14 and inflatable gripper assembly 4 in relation to the shaft or tunnel being bored. With the exception of inflatable gripper assembly 4 and cylinders 12, all of the components described in regard to down reamer 2 are found in U.S. Pat No. 5,325,932 issued to Anderson et al. for DOWN REAMING APPARATUS, which is incorporated herein by reference.

Drill string 22 passes through mounting frame 6 of inflatable gripper assembly 4 and into planetary gearbox 14. Drill string 22 is rotated by a motor means known in the art to facilitate the cutting or boring action of down reamer 2, as will be described in further detail below. Cutter head 24 is connected to the underside of planetary gearbox 14 by torque tube 25 and spider support arms 26. Cutter head 24 has a plurality of cutters 28 located thereon for cutting rock or packed earth. Lower stabilizer 30 is attached under cutter head 24 and precedes cutter head 24 into the previously bored pilot hole in order to provide additional stability for down reamer 2.

As drill string 22 is rotated, stabilizing feet 20, lower stabilizer 30, and inflatable gripper assembly 4, being braced against the wall of the bored hole, do not rotate with the drill string 22. Cutter head 24, torque tube 25 and spider support arms 26 all rotate with the drill string 22 to effectuate cutting or boring. To initiate cutting or boring, thrust cylinders 12 are first configured in their retracted position and, as drill string 22 rotates cutter head 24, thrust cylinders 12 are energized to their extended position. At this time, inflatable gripper assembly 4 has been inflated, as will be described below in greater detail, to brace down reamer 2 against the wall of the shaft or tunnel being bored. At the end of the stroke of thrust cylinders 12, the rotation of cutter head 24 is stopped and inflatable gripper assembly 4 is deflated while thrust cylinders 12 are retracted, thus pulling inflatable gripper assembly 4 along the length of the shaft or tunnel that is equivalent to the bore stroke of down reamer 2. Inflatable gripper assembly 4 is then re-inflated and cutter head 24 is again rotated to begin another cutting sequence as thrust cylinders 12 are again energized.

Figure 3:
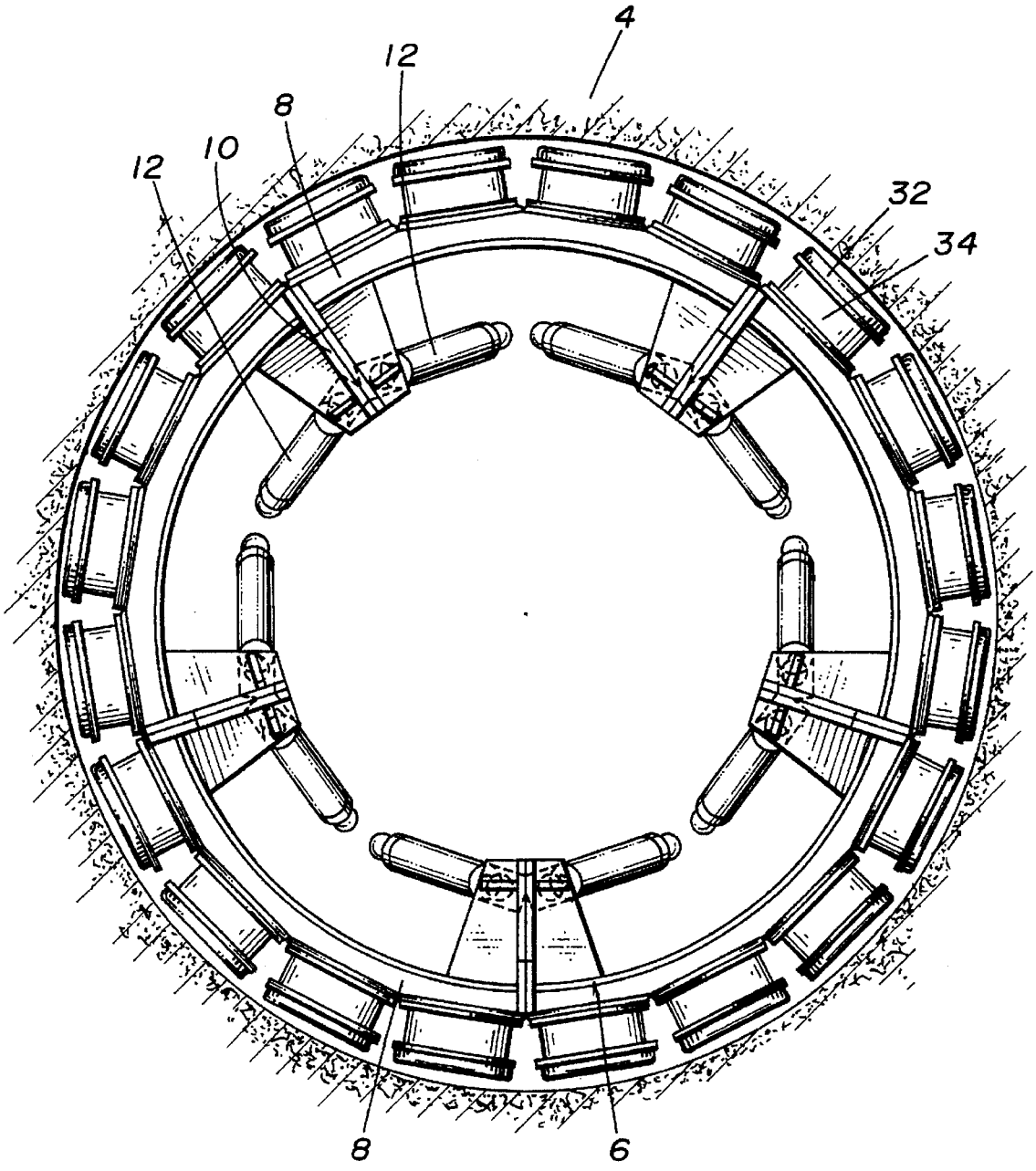
FIG. 3 is a partially exposed top view of the inflatable gripper assembly of the present invention attached to a first exemplary rock boring machine with the addition of extension shims therebetween.

Referring now to FIG. 3, if the cutting diameter of cutter head 24 is, for example, increased such that the diameter of the bore hole being cut will increase, it is necessary to increase the effective diameter of inflatable gripper assembly 4 to enable the individual gripping units 32 on mounting frame 6, which comprise inflatable gripper assembly 4, to maintain contact with the bore hole when inflatable gripper assembly 4 is in the inflated configuration. Thus, extension shim 34 is fixedly secured by bolts or the like between mounting frame 6 and each individual gripping unit 32 such that the overall diameter of inflatable gripper assembly 4 will increase by an amount equivalent to twice the depth of extension shim 34.

Figure 4:
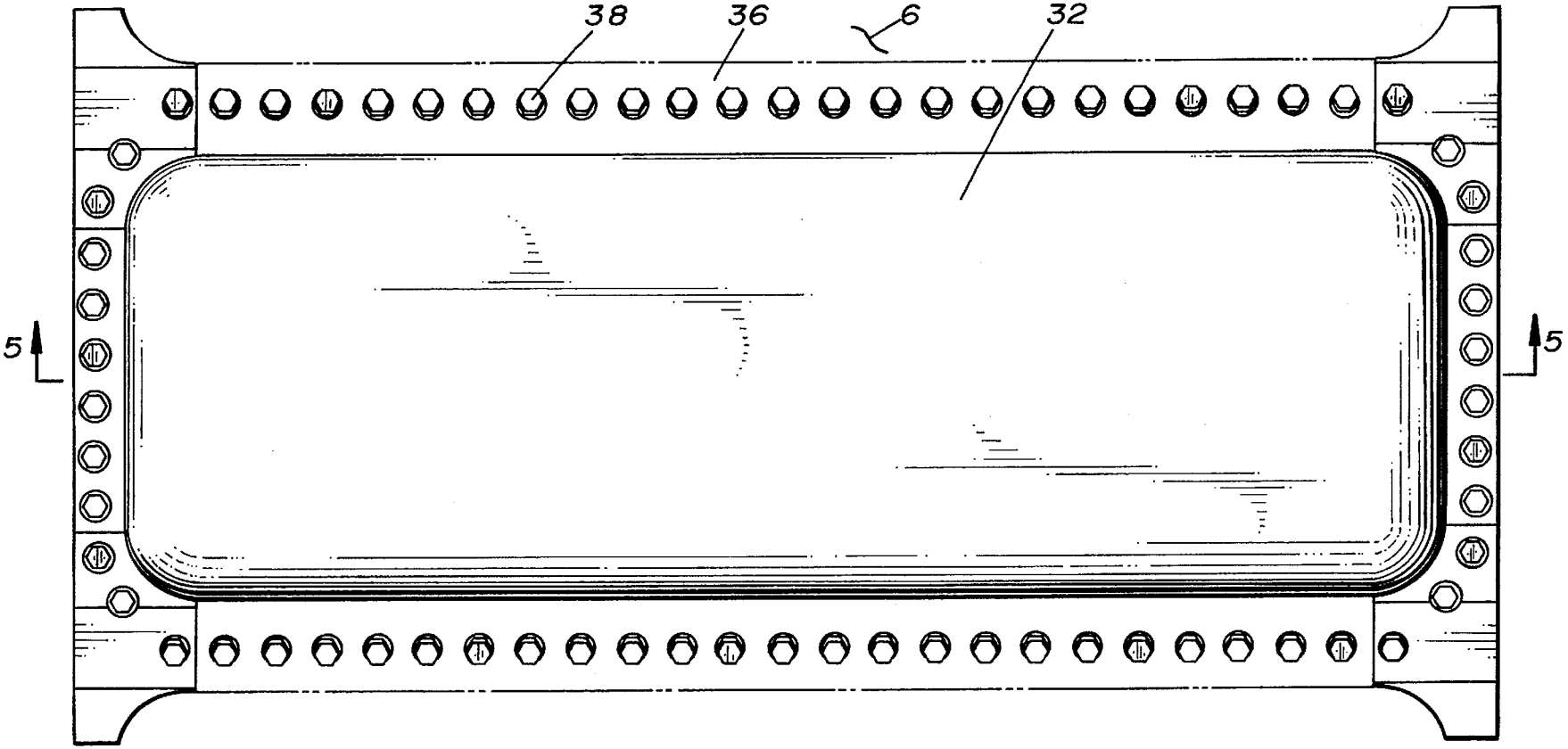
FIG. 4 is an enlarged top view of the inflatable gripper assembly of the present invention.

FIG. 4 shows an individual gripper unit 32 attached to mounting frame 6 by clamp ring 36. Clamp ring 36 is fixedly secured to mounting frame 6 by bolts 38 or other fastening means well known in the art. Clamp ring 36 need not be continuous but can consist of individual pieces to facilitate assembly.

Figure 5:
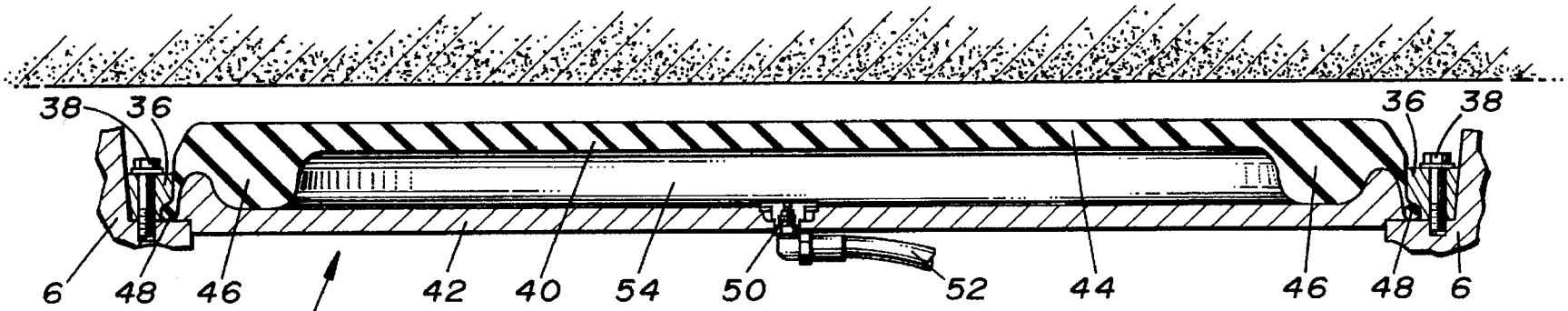
FIG. 5 is a cross-sectional view of the inflatable gripper assembly of the present invention in an uninflated configuration of FIG. 4 taken along lines 5—5.
Figure 6:
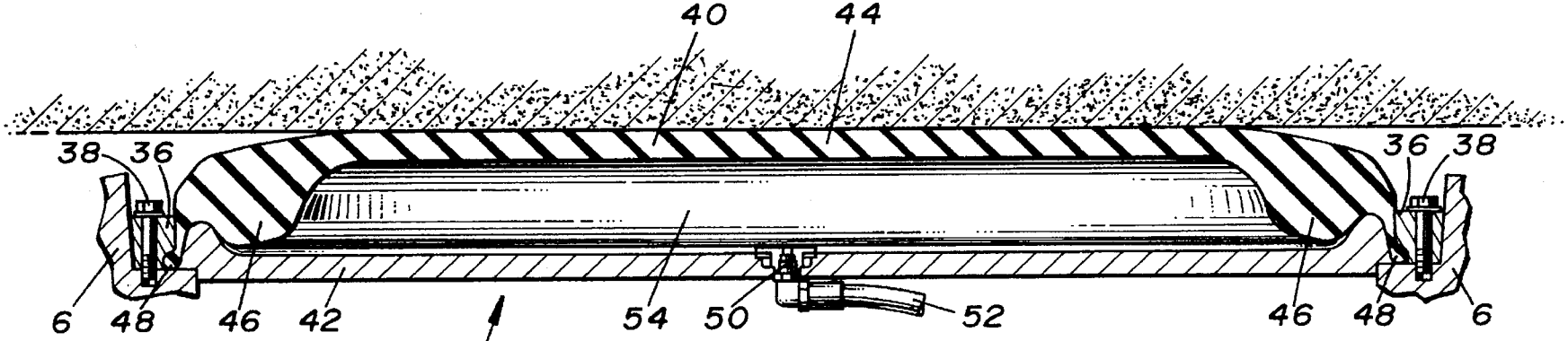
FIG. 6 is a cross-sectional view of the inflatable gripper assembly of the present invention in an inflated configuration of FIG. 4 taken again along lines 5—5.

Referring to FIG. 5, which shows individual gripper unit 32 in its deflated configuration, and in FIG. 6 which shows individual gripper unit 32 in its inflated configuration contacting a bored hole, gripper unit 32 is comprised of elastomeric sheet 40 and base 42. Elastomeric sheet 40 is comprised of any material having suitable elastic and fluid retentive qualities to allow fluid to be retained under pressure between elastomeric sheet 40 and base 42 such that the fluid pressure causes elastomeric sheet 40 to expand to facilitate gripping of down reamer 2 against a bore hole wall. For example, elastomeric sheet 40 can be comprised of rubber or a non-porous synthetic polymer having elastomeric qualities. Elastomeric sheet 40 preferably has an interior inflatable length (defined as the interior length that can receive and contain fluid) that is no greater than the length of base 42. Elastomeric sheet 40 has an interior inflatable width (defined as the interior width that can receive and contain fluid) that is no greater than the width of base 42. The above interior inflatable length and interior inflatable width limitations on elastomeric sheet 40 ensure that the movement of elastomeric sheet 40 relative to the wall of the bore hole and parallel with the longitudinal axis of down reamer 2 is minimized to limit tearing of elastomeric sheet 40 and separation of elastomeric sheet 40 from base 42. Elastomeric sheet 40 preferably has a central portion 44 and an outer periphery 46. The thickness of central portion 44 is preferably less than the thickness of outer periphery 46 to reduce the volume and hence the cost of elastomeric sheet 40 in the construction of the gripper assembly 4. The outermost extent of outer periphery 46 forms ridge 48 which is firmly, but removably, secured between clamping ring 36 and base 42 to ensure a fluid-tight attachment of elastomeric sheet 40 to base 42 and to positively react the axial and tangential forces resulting from the thrust and torque of the boring machine. In the event that fluid leakage persists around ridge 48, an inflatable bladder (not shown) can be employed in a similar manner.

Base 42 is preferably substantially planar, lacking any substantial curvature such that base 42 and elastomeric sheet 40 can be removed as a unit from down reamer 2 and transferred to a different rock boring or cutting machine having a circumference different than that of the circumference of down reamer 2. To facilitate the aforesaid transfer of elastomeric sheet 40 and base 42 to another rock boring or cutting machine, base 42 is removable from mounting frame 6. Fluid valve 50 in base 42 allows fluid to pass through fluid line 52 and into fluid chamber 54 that is formed between base 42 and elastomeric sheet 40 to inflate and deflate gripper unit 32.

Figure 7:
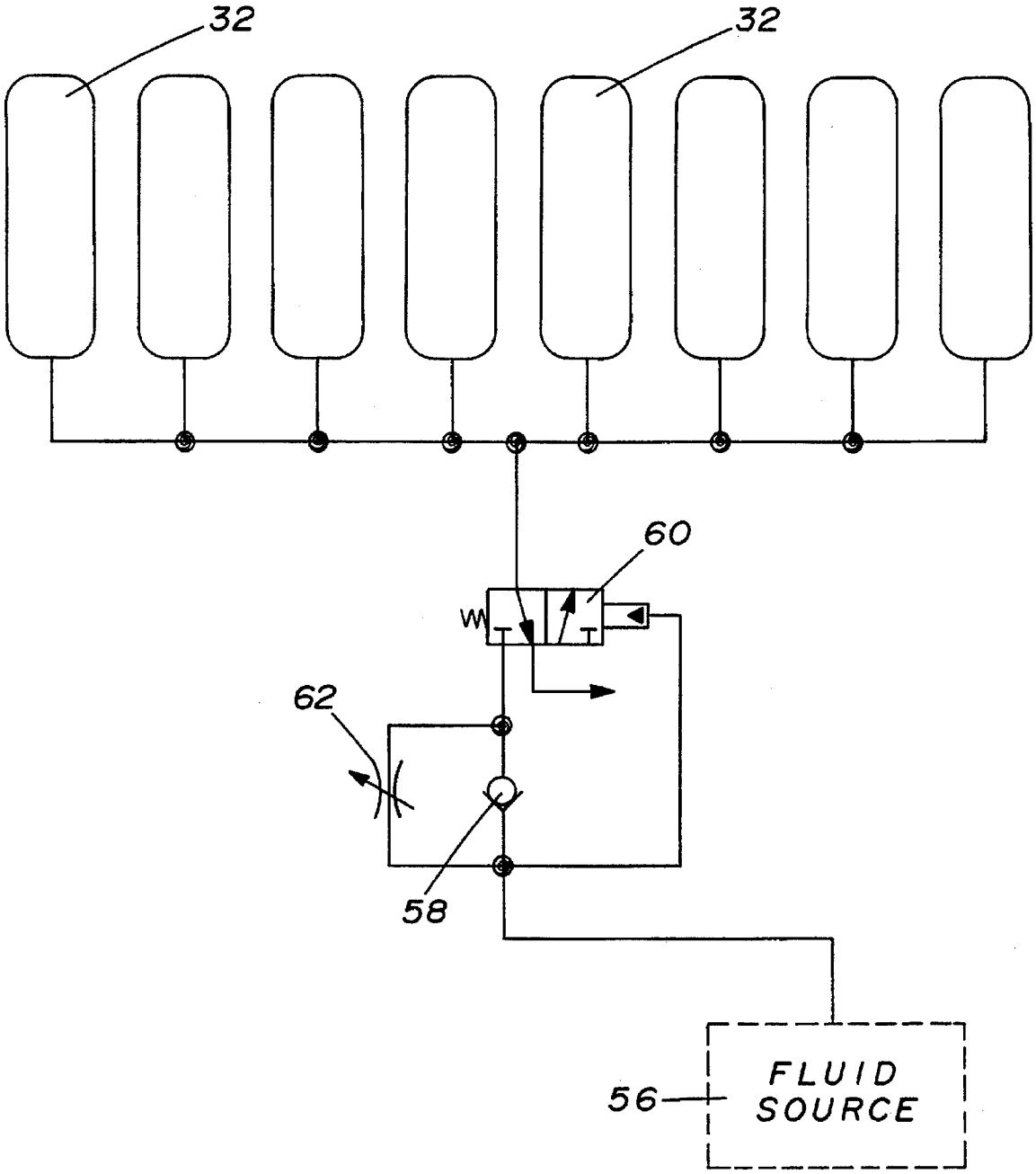
FIG. 7 is a schematic view of an exemplary fluid system for actuating the inflatable gripper assembly of the present invention.

As shown in FIG. 7, the fluid system employed to inflate and deflate gripping units 32 of inflatable gripper assembly 4 is comprised of a fluid source 56 which communicates with check valve 58. Check valve 58 ensures that when fluid source 56, which is preferably a compressor operating at approximately 8–14 bar, is deactivated fluid does not pass back into fluid source 56. Directional control valve 60 is located between check valve 58 and gripping units 32 and enables the fluid, which is for example compressed air, to either be fed to gripping units 32 to inflate them when directional control valve 60 is configured in a first position, or allows the fluid to escape to atmosphere from gripping units 32 to deflate them when directional control valve is configured in a second position. Needle valve 62 is employed to manually by-pass the check valve 58 if required.

Figure 8:
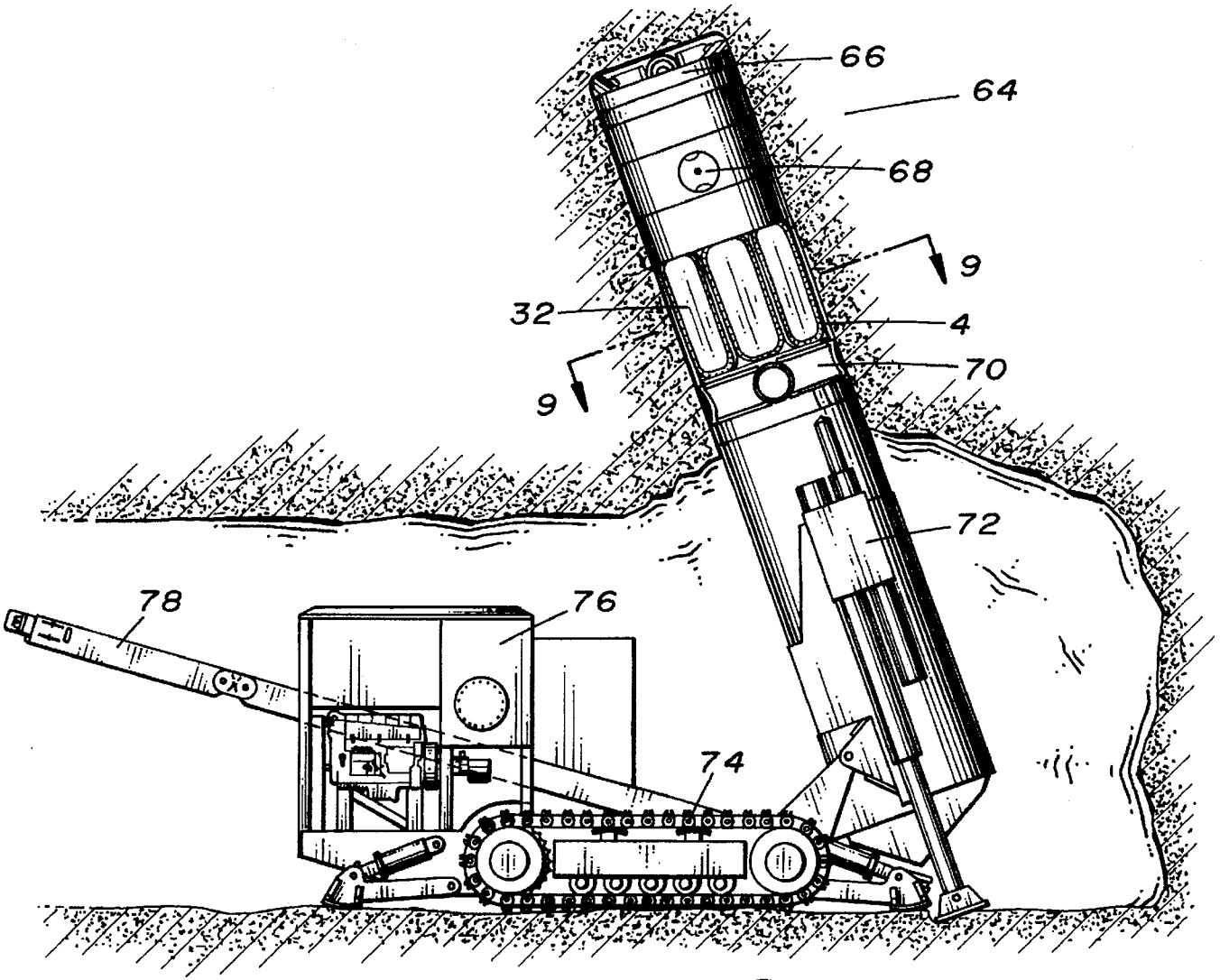
FIG. 8 is a side elevational view, partially exposed, of the inflatable gripper assembly of the present invention attached to a second exemplary rock boring machine.
Figure 9:
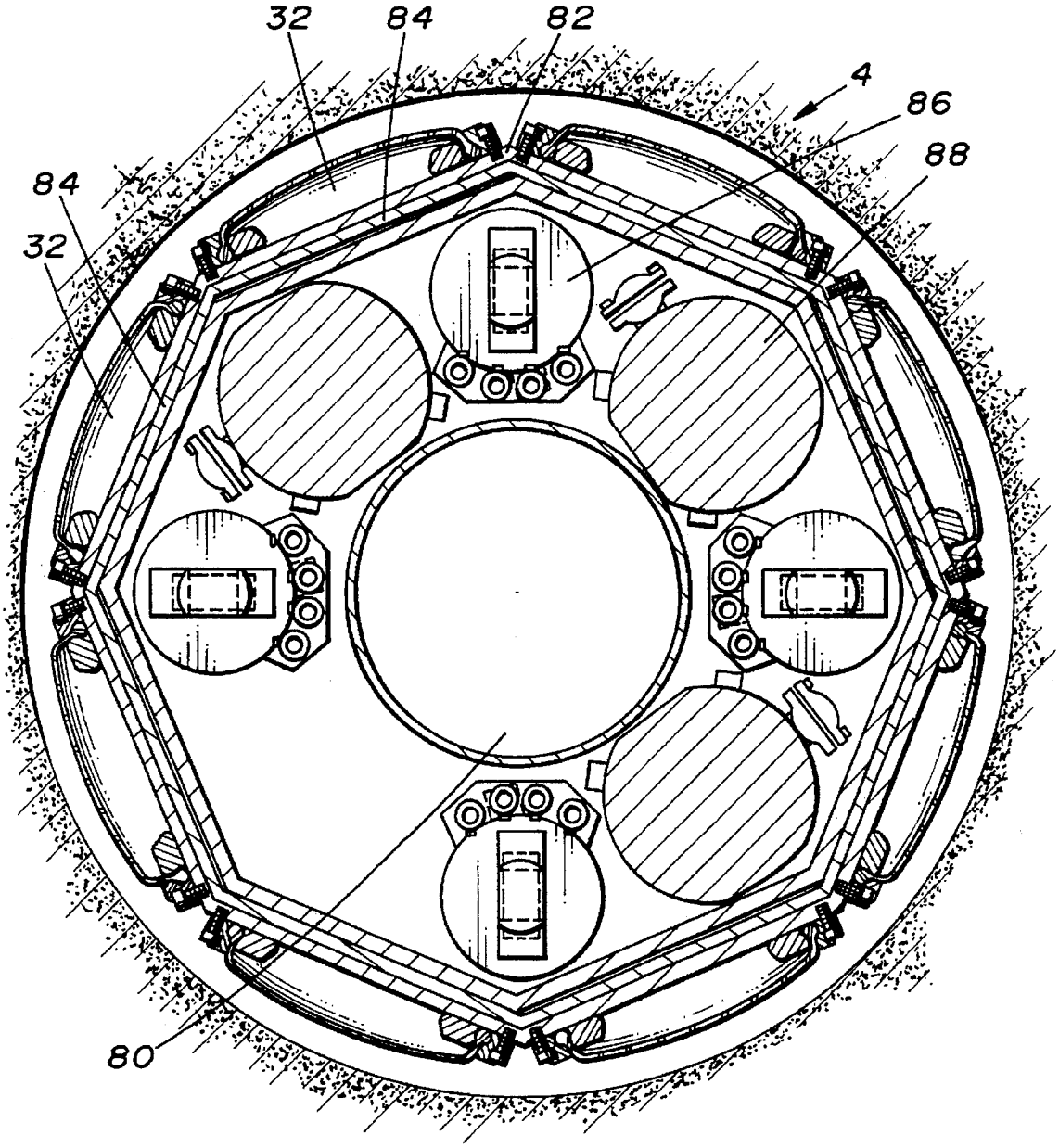
FIG. 9 is a cross-sectional view of the inflatable gripper assembly of the present invention attached to a second exemplary rock boring machine of FIG. 8 taken along lines 9—9.

Referring to FIGS. 8 and 9, miniature tunnel boring machine 64, a second exemplary rock boring machine is shown which, unlike down reamer 2, bores shafts vertically, or at angles from vertical, up through rock. Miniature tunnel boring machine 64 is comprised of cutter head 66 having stabilizing shoes 68 thereon. Inflatable gripper assembly 4, which can be comprised of the same gripping units 32 employed on down reamer 2 despite the difference in circumference between down reamer 2 and miniature tunnel boring machine 64 due to the planar aspect of base 42, is located between cutter head 66 and emergency gripper 70. Emergency gripper 70 engages in the event that power is lost. Launching tube 72 is located rearwardly of emergency gripper 70 and is configured to propel cutter head 66 and inflatable gripper assembly 4 up into a rock face to cut the desired bore hole. Launching tube 72 is supported by crawler 74 which has cab 76 thereon. Rock conveyor 78 extends past cab 76 and communicates with launching tube 72 for the transport of cut rock from cutter head central opening 80 and through launching tube 72.

As shown in FIG. 9, gripping units 32 are attached to mounting frame 82 which is comprised of a plurality of faces 84 such that mounting frame 82 is substantially octagonal in shape whereby each of faces 84 supports one of gripping units 32 thereon. It is to be understood that gripping units 32 are comprised of the same elements as described in relation to down reamer 2 and, as stated above, gripping units 32 can be the identical gripping units that have been transferred from down reamer 2; the only difference being that fewer gripping units 32 are employed on miniature tunnel boring machine 64 than on down reamer 2 because miniature tunnel boring machine 64 has a smaller diameter than that of down reamer 2. Thrust cylinders 86 are connected between gripper assembly 4 and cutter head 66 to provide relative movement, or thrusting, between cutter head 66 and mounting frame 82 during boring, as described above in relation to down reamer 2. Also as described in relation to down reamer 2, gripping units 32 are inflated and deflated to allow gripping and advancing of cutter head 66, respectively. The only major difference to be noted regarding the functioning of down reamer 2 and miniature tunnel boring machine 64 is that, during the initial advancing of cutter head 66, launching tube 72 provides the advancing reaction forces while in down reamer 2, the initial advancing reaction forces are provided by a pre-developed shaft. As shown in FIG. 9, motors 88 are employed to facilitate rotation of cutter head 66 during cutting.

While particular embodiments of the present invention have been described in some detail herein above, changes and modifications may be made in the illustrated embodiments without departing from the spirit of the invention.

I claim:

1. An inflatable gripper assembly for a rock boring machine comprising:

a planar base member; and an elastomeric sheet secured in a fluid-tight manner to said planar base member such that said elastomeric sheet expands when fluid is supplied between said planar base member and said elastomeric sheet to brace a rock boring machine in a tunnel and such that said elastomeric sheet contracts when fluid is removed from between said planar base member and said elastomeric sheet to allow a rock boring machine to move within a tunnel, said planar base member allowing said inflatable gripper assembly to be installed on rock boring machines of differing dimensions.

2. The inflatable gripper assembly of claim 1 wherein said base member has a length and a width, said elastomeric sheet has an interior inflatable length that is no greater than said length of said base member, said elastomeric sheet has an interior inflatable width that is no greater than said width of said base member.

3. The inflatable gripper assembly of claim 1 further comprising a ridge circumferentially disposed on said base member, said elastomeric sheet having an outer edge secured over said ridge of said base member in a fluid-tight manner.

4. The inflatable gripper assembly of claim 1 further comprising a shim having a predetermined depth, said shim being attachable between said gripper assembly and a rock boring machine to increase the diameter of the rock boring machine.

5. The inflatable gripper assembly of claim 1 wherein said elastomeric sheet has a central portion of a predetermined thickness and has an outer periphery of a predetermined thickness that is greater than the predetermined thickness of said central portion.

6. An inflatable gripper assembly for a rock boring machine comprising:

a planar base member having a length and a width; and an elastomeric sheet secured in a fluid-tight manner to said base member such that said elastomeric sheet expands when fluid is supplied between said base member and said elastomeric sheet to brace a rock boring machine in a tunnel and such that said elastomeric sheet contracts when fluid is removed from between said base member and said elastomeric sheet to allow a rock boring machine to move within a tunnel, said elastomeric sheet having an interior inflatable length that is no greater than said length of said base member, said elastomeric sheet having an interior inflatable width that is no greater than said width of said base member.

7. The inflatable gripper assembly of claim 6 further comprising a ridge circumferentially disposed on said base member, said elastomeric sheet having an outer edge secured over said ridge of said base member in a fluid-tight manner.

8. The inflatable gripper assembly of claim 6 wherein said elastomeric sheet has a central portion of a predetermined thickness and has an outer periphery of a predetermined thickness that is greater than the predetermined thickness of said central portion.

9. An inflatable gripper assembly for a rock boring machine comprising:

a base member having a ridge circumferentially disposed thereon; and an elastomeric sheet having an outer edge secured over said ridge of said base member in a fluid-tight manner such that said elastomeric sheet expands when fluid is supplied between said base member and said elastomeric sheet to brace a rock boring machine in a tunnel and such that said elastomeric sheet contracts when fluid is removed from between said base member and said elastomeric sheet to allow a rock boring machine to move within a tunnel.

10. The inflatable gripper assembly of claim 9 wherein said base member has a length and a width, said elastomeric sheet has an interior inflatable length that is no greater than said length of said base member, said elastomeric sheet has an interior inflatable width that is no greater than said width of said base member.

11. The inflatable gripper assembly of claim 9 wherein said base member is planar to allow said inflatable gripper assembly to be installed on rock boring machines of differing diameters.

12. The inflatable gripper assembly of claim 9 wherein said elastomeric sheet has a central portion of a predetermined thickness and has an outer periphery of a predetermined thickness that is greater than the predetermined thickness of said central portion.

13. An inflatable gripper assembly for a rock boring machine comprising:

a planar base member having a length and a width; and an elastomeric sheet secured in a fluid-tight manner to said planar base member such that said elastomeric sheet expands when fluid is supplied between said planar base member and said elastomeric sheet to brace a rock boring machine in a tunnel and such that said elastomeric sheet contracts when fluid is removed from between said planar base member and said elastomeric sheet to allow a rock boring machine to move within a tunnel, said planar base member allowing said inflatable gripper assembly to be installed on rock boring machines of differing diameters, said elastomeric sheet having an interior inflatable length that is no greater than said length of said base member, said elastomeric sheet having an interior inflatable width that is no greater than said width of said base member.

14. The inflatable gripper assembly of claims 13 further comprising a ridge circumferentially disposed on said base member, said elastomeric sheet having an outer edge secured over said ridge of said base member in a fluid-tight manner.

15. The inflatable gripper assembly of claim 13 further comprising a shim having a predetermined depth, said shim being attachable between said gripper assembly and a rock boring machine to increase the diameter of the rock boring machine.

16. The inflatable gripper assembly of claim 13 wherein said elastomeric sheet has a central portion of a predetermined thickness and has an outer periphery of a predetermined thickness that is greater than the predetermined thickness of said central portion.

17. An inflatable gripper assembly for a rock boring machine comprising:

a planar base member having a ridge circumferentially disposed thereon; and an elastomeric sheet having an outer edge secured over said ridge of said planar base member in a fluid-tight manner such that said elastomeric sheet expands when fluid is supplied between said planar base member and said elastomeric sheet to brace a rock boring machine in a tunnel and such that said elastomeric sheet contracts when fluid is removed from between said planar base member and said elastomeric sheet to allow a rock boring machine to move within a tunnel, said planar base member allowing said inflatable gripper assembly to be installed on rock boring machines of differing diameters.

18. The inflatable gripper assembly of claim 17 wherein said base member has a length and a width, said elastomeric sheet has an interior inflatable length that is no greater than said length of said base member, said elastomeric sheet has an interior inflatable width that is no greater than said width of said base member.

19. The inflatable gripper assembly of claim 17 further comprising a shim having a predetermined depth, said shim being attachable between said gripper assembly and a rock boring machine to increase the diameter of the rock boring machine.

20. The inflatable gripper assembly of claim 17 wherein said elastomeric sheet has a central portion of a predetermined thickness and has an outer periphery of a predetermined thickness that is greater than the predetermined thickness of said central portion.

21. An inflatable gripper assembly for a rock boring machine comprising:

a base member having a length, a width and a ridge circumferentially disposed thereon; and an elastomeric sheet having an outer edge secured over said ridge of said base member in a fluid-tight manner such that said elastomeric sheet expands when fluid is supplied between said base member and said elastomeric sheet to brace a rock boring machine in a tunnel and such that said elastomeric sheet contracts when fluid is removed from between said base member and said elastomeric sheet to allow a rock boring machine to move within a tunnel, said elastomeric sheet having an interior inflatable length that is no greater than said length of said base member, said elastomeric sheet having an interior inflatable width that is no greater than said width of said base member.

22. The inflatable gripper assembly of claim 21 wherein said base member is planar to allow said inflatable gripper assembly to be installed on rock boring machines of differing diameters.

23. The inflatable gripper assembly of claim 21 wherein said elastomeric sheet has a central portion of a predetermined thickness and has an outer periphery of a predetermined thickness that is greater than the predetermined thickness of said central portion.

24. An inflatable gripper assembly for a rock boring machine comprising:

a planar base member having a length, a width and a ridge circumferentially disposed thereon; and an elastomeric sheet having an outer edge secured over said ridge of said base member in a fluid-tight manner such that said elastomeric sheet expands when fluid is supplied between said planar base member and said elastomeric sheet to brace a rock boring machine in a tunnel and such that said elastomeric sheet contracts when fluid is removed from between said planar base member and said elastomeric sheet to allow a rock boring machine to move within a tunnel, said planar base member allowing said inflatable gripper assembly to be installed on rock boring machines of differing diameters, said elastomeric sheet having an interior inflatable length that is no greater than said length of said planar base member, said elastomeric sheet having an interior inflatable width that is no greater than said width of said base member.

25. The inflatable gripper assembly of claim 24 further comprising a shim having a predetermined depth, said shim being attachable between said gripper assembly and a rock boring machine to increase the diameter of the rock boring machine.

26. The inflatable gripper assembly of claim 24 wherein said elastomeric sheet has a central portion of a predetermined thickness and has an outer periphery of a predetermined thickness that is greater than the predetermined thickness of said central portion.

27. An inflatable gripper assembly for a rock boring machine comprising:

a base member having a length and a width;

an elastomeric sheet secured in a fluid-tight manner to said base member such that said elastomeric sheet expands when fluid is supplied between said base member and said elastomeric sheet to brace a rock boring machine in a tunnel and such that said elastomeric sheet contracts when fluid is removed from between said base member and said elastomeric sheet to allow a rock boring machine to move within a tunnel, said elastomeric sheet having an interior inflatable length that is no greater than said length of said base member, said elastomeric sheet having an interior inflatable width that is no greater than said width of said base member; and a ridge circumferentially disposed on said base member, said elastomeric sheet having an outer edge secured over said ridge of said base member in a fluid-tight manner.

28. An inflatable gripper assembly for a rock boring machine comprising:

a base member having a length and a width;

an elastomeric sheet secured in a fluid-tight manner to said base member such that said elastomeric sheet expands when fluid is supplied between said base member and said elastomeric sheet to brace a rock boring machine in a tunnel and such that said elastomeric sheet contracts when fluid is removed from between said base member and said elastomeric sheet to allow a rock boring machine to move within a tunnel, said elastomeric sheet having an interior inflatable length that is no greater than said length of said base member, said elastomeric sheet having an interior inflatable width that is no greater than said width of said base member; and said elastomeric sheet further having a central portion of a predetermined thickness and an outer periphery of a predetermined thickness that is greater than the predetermined thickness of said central portion.

* * * * *